US007946338B2

(12) United States Patent
Szabó

(10) Patent No.: US 7,946,338 B2
(45) Date of Patent: May 24, 2011

(54) COMBINED AIR COOLED CONDENSER

(75) Inventor: Zoltán Szabó, Budapest (HU)

(73) Assignee: EGI-Contracting Engineering Co., Ltd., Budapest (HU)

( * ) Notice: Subject to any disclaimer, the term of this patent is extended or adjusted under 35 U.S.C. 154(b) by 1293 days.

(21) Appl. No.: 10/546,472

(22) PCT Filed: Jun. 27, 2003

(86) PCT No.: PCT/HU03/00055

§ 371 (c)(1),
(2), (4) Date: Aug. 22, 2005

(87) PCT Pub. No.: WO2004/094932

PCT Pub. Date: Nov. 4, 2004

(65) Prior Publication Data

US 2006/0151154 A1 Jul. 13, 2006

(30) Foreign Application Priority Data

Apr. 24, 2003 (HU) ..... 0301127

(51) Int. Cl.
*F28B 1/00* (2006.01)
*F28F 13/06* (2006.01)

(52) U.S. Cl. ..... 165/110; 165/60; 165/108

(58) Field of Classification Search ..... 165/110, 165/60, 108, 113, 115
See application file for complete search history.

(56) References Cited

U.S. PATENT DOCUMENTS

| | | | | | |
|---|---|---|---|---|---|
| 2,069,653 | A | * | 2/1937 | Hosel | 165/104.31 |
| 3,151,461 | A | * | 10/1964 | Sebald et al. | 60/656 |
| 4,190,102 | A | * | 2/1980 | Gerz | 165/113 |
| 4,301,861 | A | | 11/1981 | Larinoff | |
| 4,449,368 | A | * | 5/1984 | Haynie | 60/652 |
| 4,506,508 | A | * | 3/1985 | Coers et al. | 60/652 |
| 5,355,943 | A | * | 10/1994 | Gonano et al. | 165/112 |
| 5,765,629 | A | * | 6/1998 | Goldsmith et al. | 165/112 |
| 5,950,717 | A | * | 9/1999 | Fay | 165/113 |
| 6,070,655 | A | * | 6/2000 | Heikkila | 165/111 |
| 6,332,494 | B1 | | 12/2001 | Bodas et al. | |
| 6,588,499 | B1 | * | 7/2003 | Fahlsing | 165/231 |

FOREIGN PATENT DOCUMENTS

| | | | |
|---|---|---|---|
| FR | 877 696 | | 12/1942 |
| GB | 2226962 | A * | 7/1990 |
| JP | 59-50160 | | 3/1984 |
| WO | 90/07633 | | 7/1990 |
| WO | 98/02701 | | 1/1998 |

OTHER PUBLICATIONS

English Abstract of JP 59-50160; Satou Kanemitsu, et al.; Internal Structural Material for Nuclear Reactor; Mar. 23, 1984.

* cited by examiner

*Primary Examiner* — Tho v Duong
(74) *Attorney, Agent, or Firm* — Ladas & Parry LLP

(57) ABSTRACT

The invention relates to an air cooled condenser system that contains a steam-air heat exchanger (3) consisting of tubes (2) finned on the outside for the partial direct condensing of steam (1) with ambient air (4). This heat exchanger (3) receives the steam (1) from an upper distribution chamber (24) and ends in a lower chamber (25) which collects the condensate (8) and the steam (27) that has not yet condensed. The steam (22) not yet condensed in the steam-air heat exchanger (3) is condensed, in the steam-air section of the air cooled condenser, in a space operating as a direct contact condenser (9) by spraying water from the water-air cooling section (7) of the air cooled condenser, where the non-condensing gases are removed as well. The water (13) heated up in the direct contact condenser (9) is re-cooled in a water-air heat exchanger (7).

22 Claims, 9 Drawing Sheets

Figure 1:
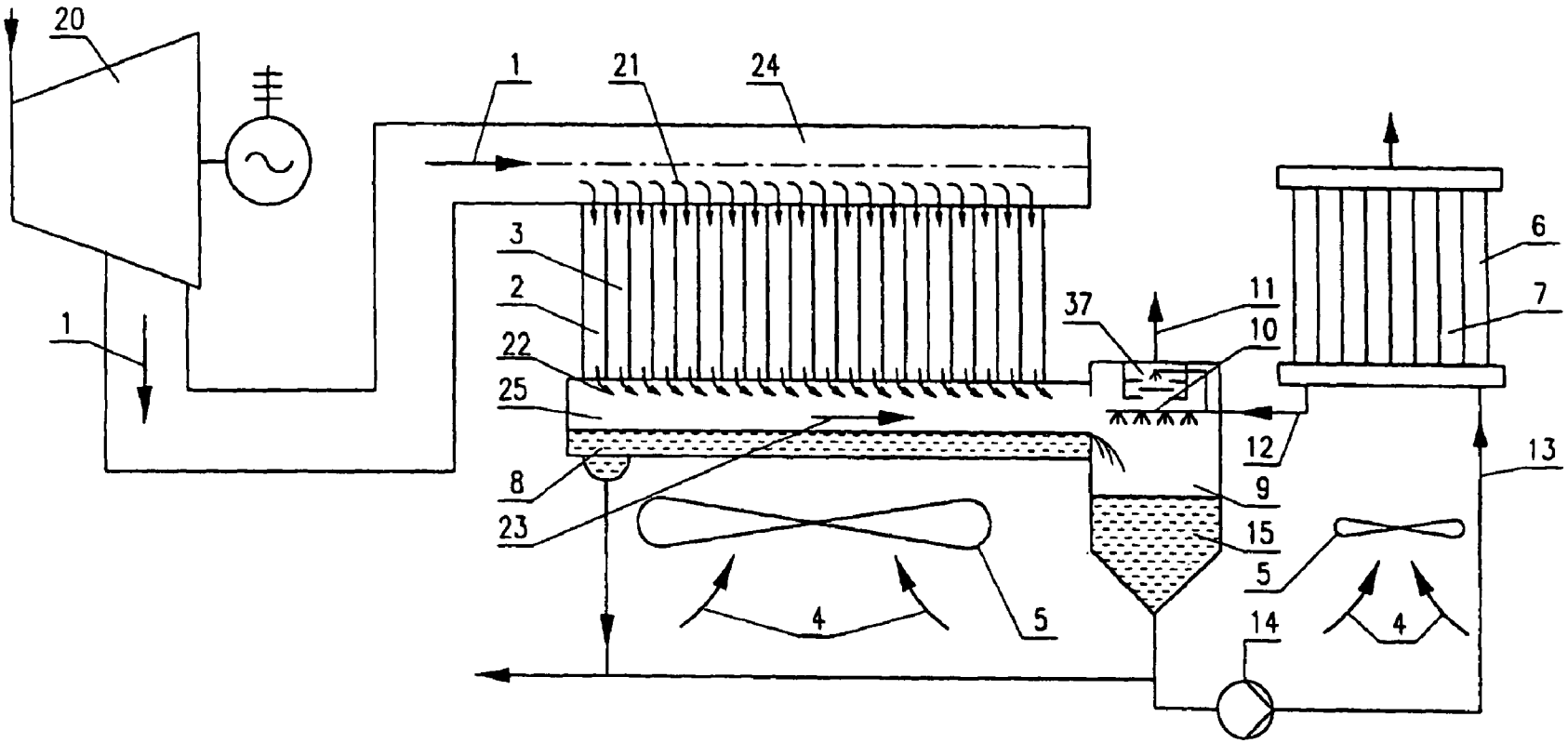

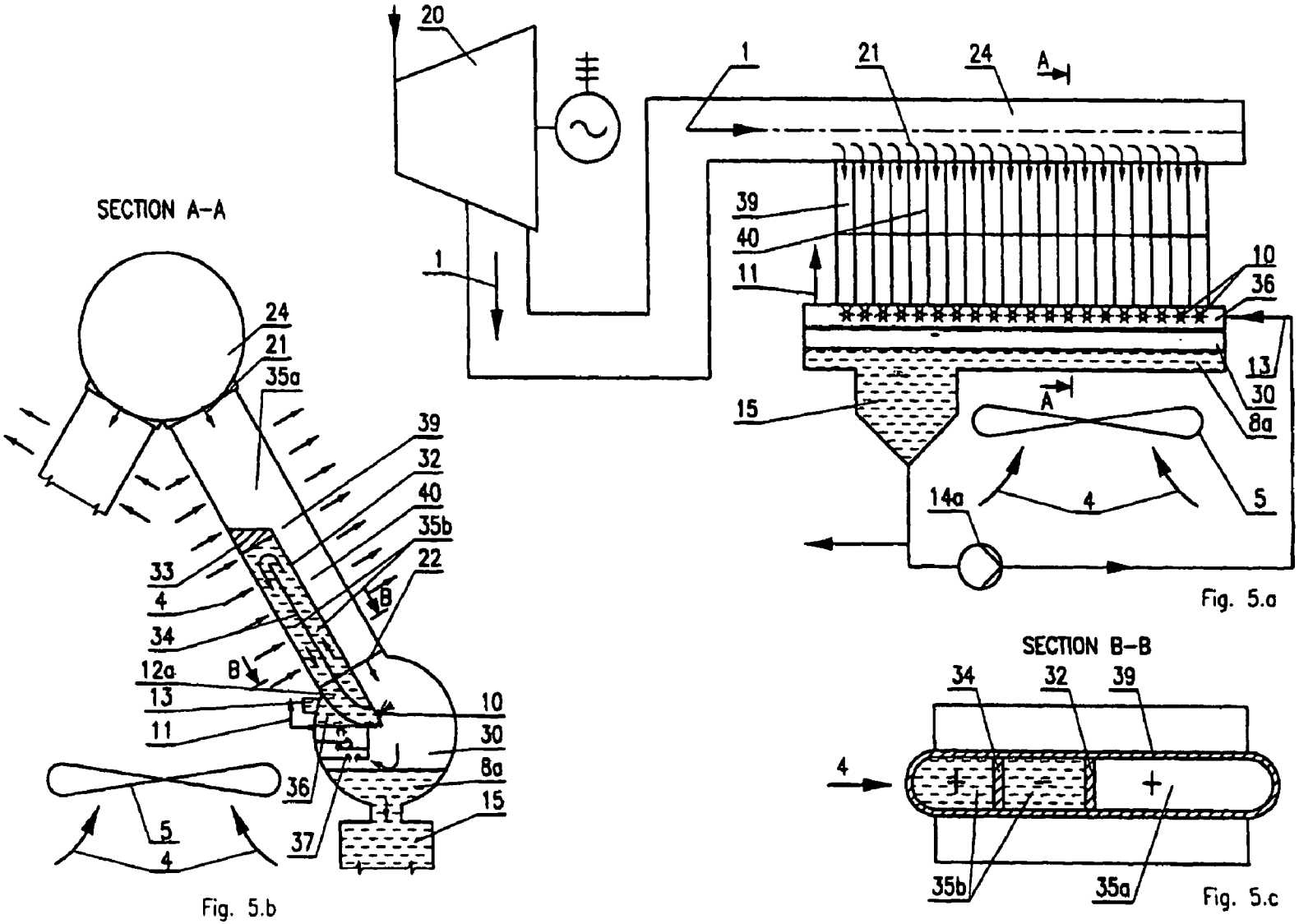
SECTION A–A
SECTION B–B
Fig. 5.a
Fig. 5.b
Fig. 5.c

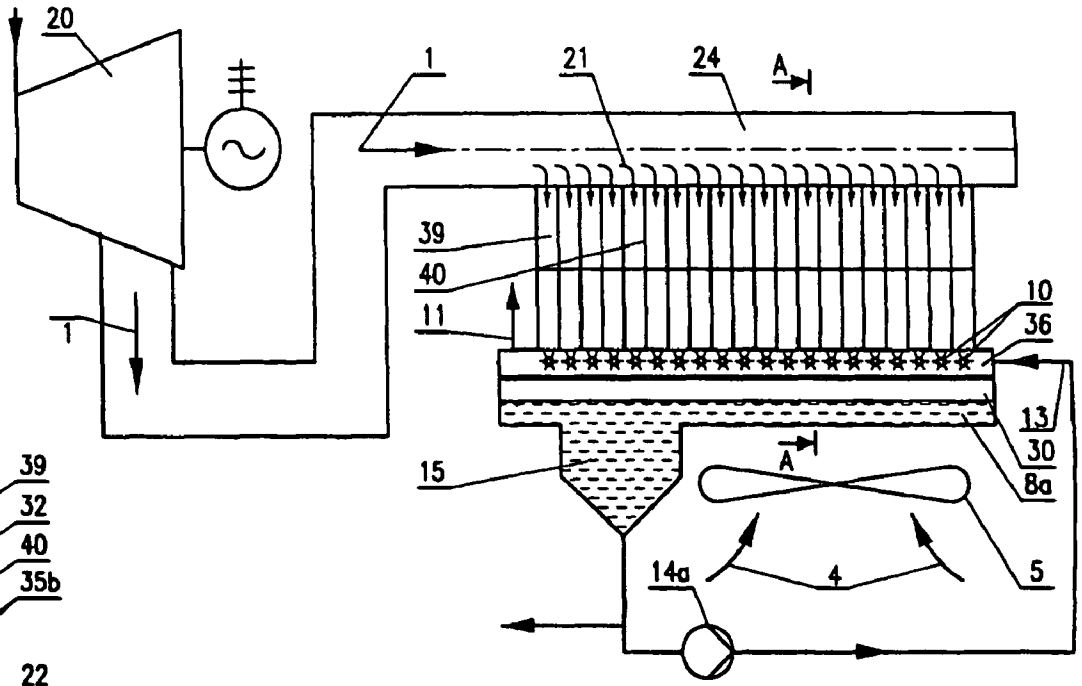
Fig. 6.a
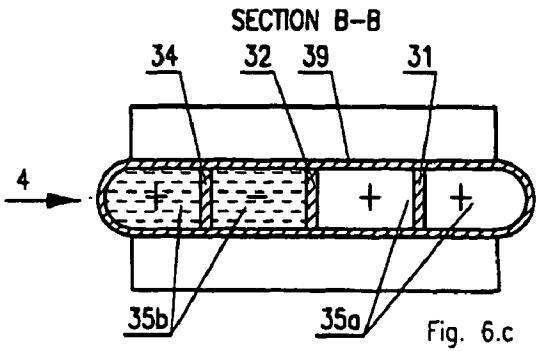
Fig. 6.c
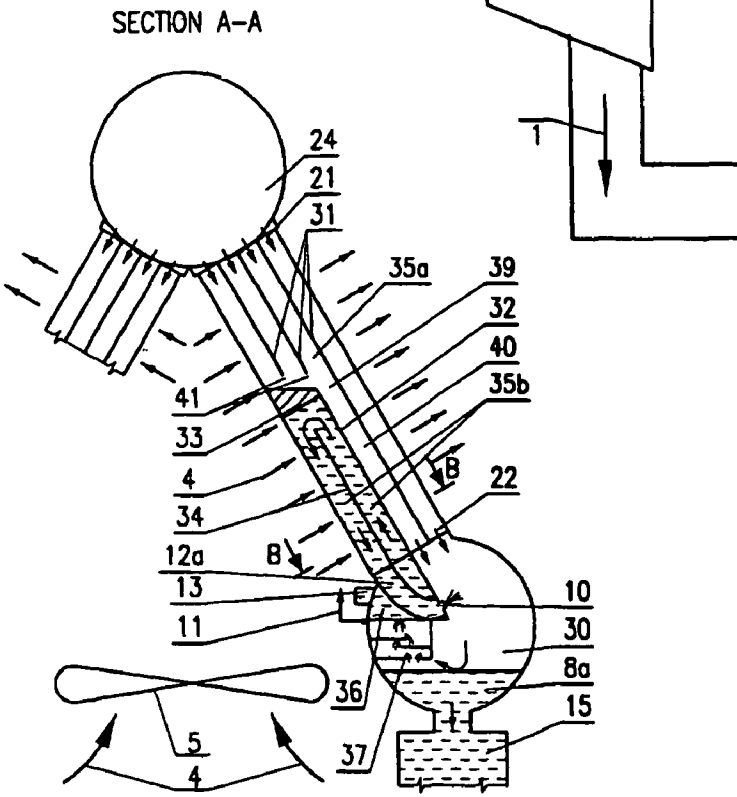
Fig. 6.b

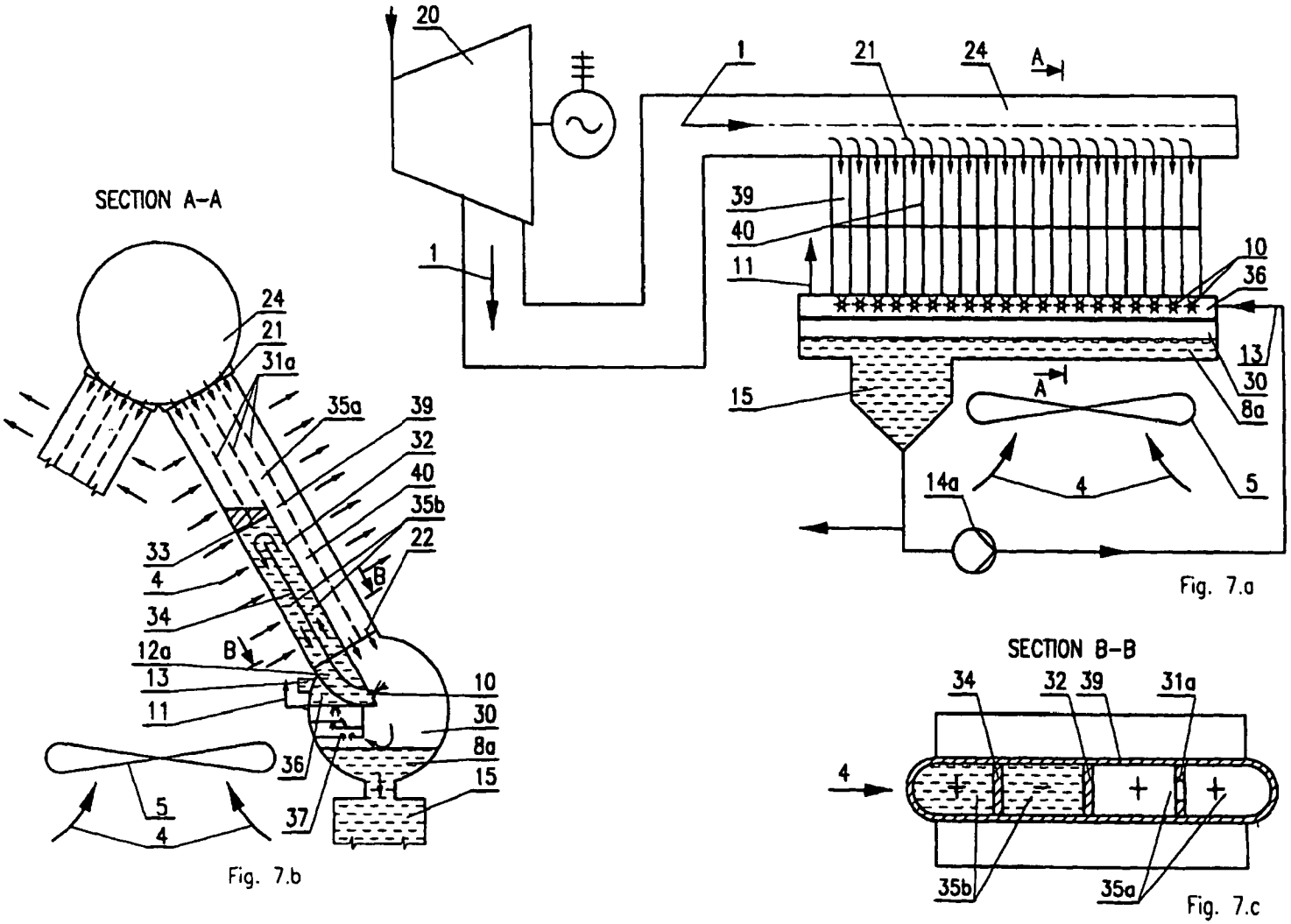
SECTION A-A
SECTION B-B
Fig. 7.a
Fig. 7.b
Fig. 7.c

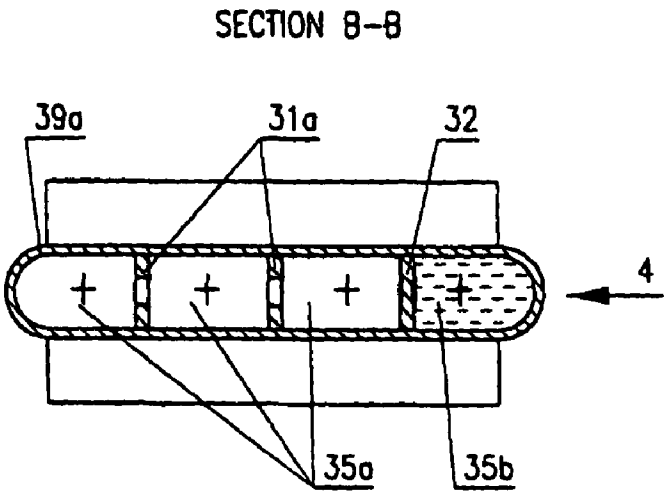
Fig. 8.b
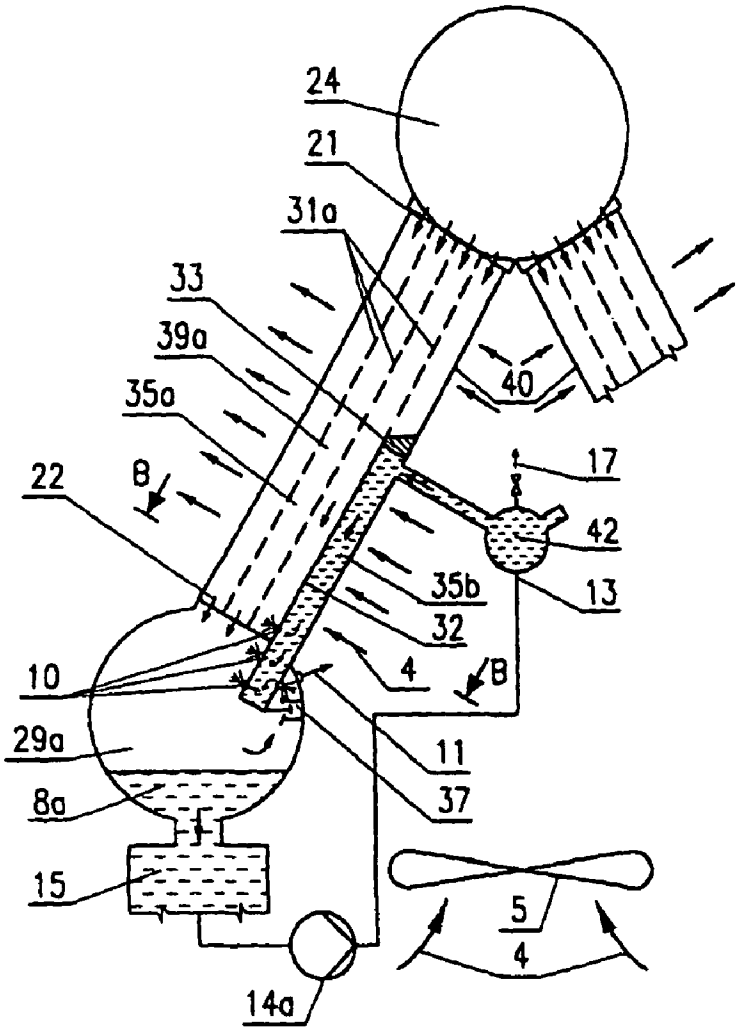
Fig. 8.a

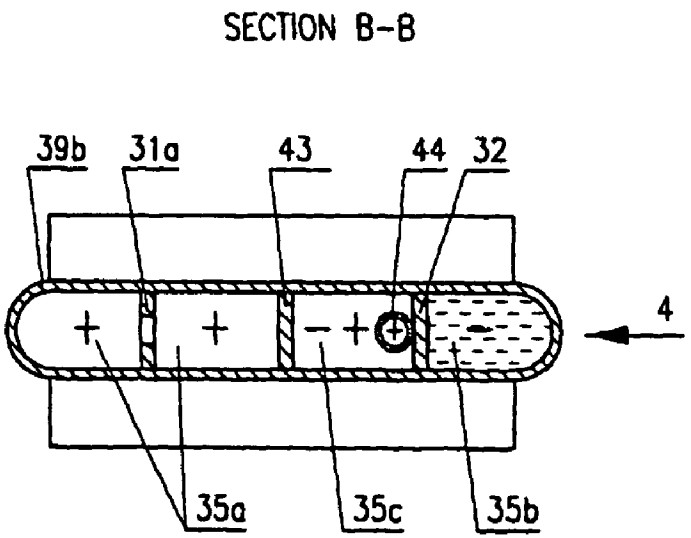
Fig. 9.b
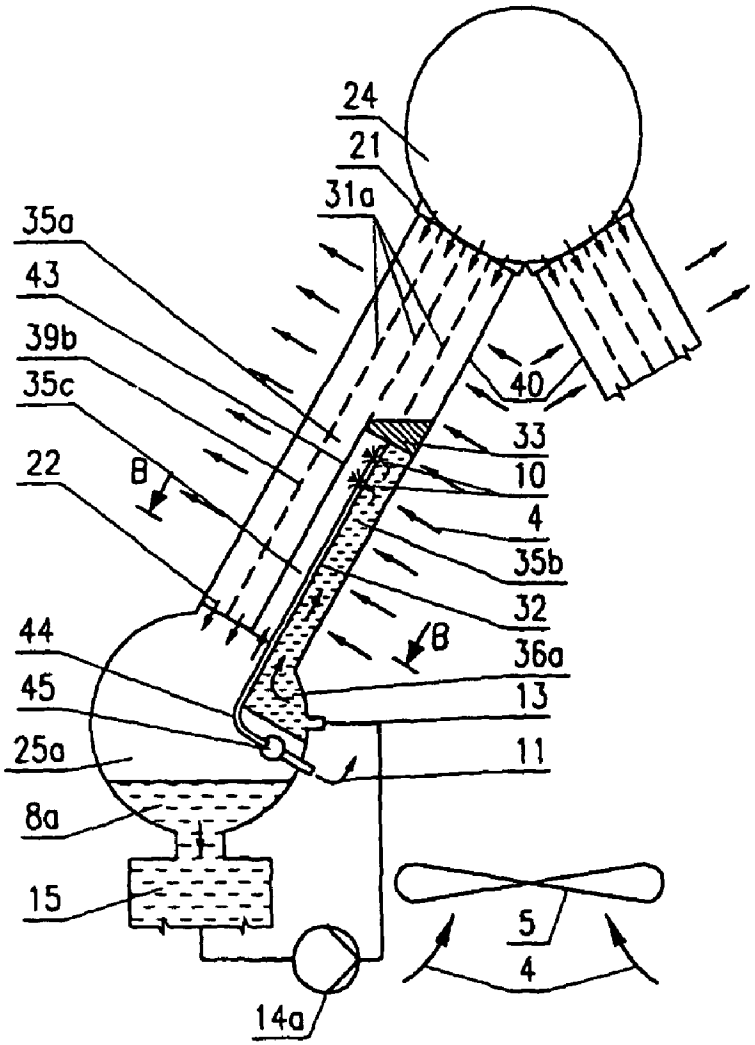
Fig. 9.a

COMBINED AIR COOLED CONDENSER

1. TECHNICAL FIELD

The subject of the invention relates to an air cooling system of power plant or industrial cycles. It carries out the condensation of the steam-state medium (generally water vapour) in the way described in the claims.

2. BACKGROUND ART

For the realisation of numerous industrial, but primarily thermal power station processes it is necessary to extract heat from the process at the ambient temperature level usually via the condensation of the steam-state operating medium of these processes. The traditional solutions involve exceptionally intensive use of water (evaporative or once-through cooling), which, due to environmental protection considerations or the lack of the required amount of water, may cause problems in numerous cases. In order to overcome this various well known and tried dry cooling systems were developed.

The most wide-spread dry cooling system is the so-called direct dry cooling. In this cooling method, if it serves power plant cycles, the water vapour, expanded in a steam turbine subjected to a vacuum, exits from the turbine through a steam pipe with a large diameter, then through an upper distribution chamber it goes into a so-called steam-air heat exchanger. The steam flowing in the fin tubes of the heat exchanger gradually condenses to the effect of the cooling air flowing on the external, finned side of the heat exchanger. As the condensation and heat extraction is realised directly without a transmitting medium, this is called direct dry cooling. Naturally safe and controllable direct cooling by air that can be technically implemented is a much more complex process than this. The process in dry cooling takes place in a decidedly wider temperature range as compared to common water cooling following the significant temperature fluctuations taking place during the year in ambient air temperature. This means that on the steam side significantly varying condenser pressure, in other words turbine back pressure will be created. Taking into consideration these varying temperature and pressure conditions from the point of view of economy it is necessary to select and operate the equipment optimally, as well as to ensure its operational reliability.

The best known and tried direct cooling by air realises the above requirements by breaking down the condensing process into two easily separable phases. In accordance with this the steam-air heat exchanger consists of two parts, the so-called condenser part and the secondary condenser, which is called an aftercooler or dephlegmator in the specialist literature.

The steam exits the steam distribution pipes, then goes through the distribution chambers of the condenser part to the finned heat exchanger tubes. The coolant air flows on the external, finned side at right angles to the longitudinal axis of the pipes, in other words perpendicular to the flow direction of the steam. The condenser may consist of multi-tubes in the direction of the air, but also of a single, extended tube. Due to the cooling effect of the air the steam gradually condenses in the tubes. The condensate goes in the same direction as the steam in a downwards direction due to gravity partially flowing on the internal wall of the tube, partially with the flowing steam to the condensate collection and steam transmission chamber positioned at the bottom end of the pipes. From here the condensate goes from the individual heat exchanger bundles to the condensate pipe. The remaining uncondensed steam (30-15 percent of the initial amount) and the unwanted, non-condensing gases present in the steam pass into a further heat exchanger section, the so-called aftercooler or dephlegmator part.

Significant differences in the degree of condensation and, with this, the concentration of non-condensing gases develop in certain pipe sections both with respect to time and space. Changes over time may be caused by a change in the temperature of the external air, a change in the steam-side loading and the airflow rate. Changes with respect to space are determined by the positioning of the heat exchanger tubes. Significant differences can develop between individual tubes in the plane perpendicular to the direction of cooling airflow due to the uneven steam or air distribution. Further unevenness is displayed in the direction of the airflow, as the cooling air gradually warms up and so is able to condense an increasingly smaller amount of steam. This effect does not only occur in the case of multiple-tube condensers in the flow direction, but also in the case of single row condenser tubes that are stretched out in the airflow direction (although to a lesser degree). The non-condensing gases can become concentrated in certain sections of the heat exchanger, so-called air-plugs can develop, terminating the flow of steam and so removing the tube section of the given heat exchanger from effective cooling. Besides this performance drop, in temperature conditions under freezing, the freezing up of the heat exchanger and significant operation breakdowns can be caused. These problems of direct cooling by air are known of in the related technical journals. (e.g. Kroger, D. G., Air Cooled Heat Exchangers and Cooling Towers, section 8, part 8.2., TEC-PRESS, 1998).

The problem caused by uneven condensation is reduced by the most widely used direct air cooled system by inserting a heat exchanger section called a dephlegmator, which essentially carries out an aftercooling function. As compared to that justified by the design in general a significantly greater amount of steam is fed from the condenser section to the dephlegmator part due to endeavours to overcome the unevenness. The dephlegmator section uses a similar heat exchanger type to that used in the condensation section, with the significant difference that the input of the steam does not take place from above but from a lower distribution chamber, from which the steam flows upwards in the heat exchanger tubes, in the mean time the condensate flows in the opposite direction to the effect of gravity to the lower steam distribution and condensate collection chamber. The circumstances causing unevenness presented in the case of the condensation section also appear here. One typical problem of this section may derive from steam side overloading, which may hold up the condensate flowing downwards due to the effect of gravity setting up a water plug and so taking out the remaining section of the tube from the operation of the heat exchanger. Over and above this drop in performance this can cause other operation problems, including freezing up problems in cold weather. In accordance with this the dephlegmator section needs to be significantly overdimensioned. A study by Goldschagg, H. B. analyses the problems of one of the most modern direct air cooled systems in existence (Lessons learned from the world's largest force draft direct cooling condenser, paper presented at the EPRI Int. Symp. on Improved Technology for Fossil Power Plants, Washington, March 1993.).

The unwanted, non-condensing gases present in the steam, consisting mainly of air have to be pumped out of the space under vacuum. The pumping work is reduced if the suction takes place in a place where the ratio of the gases in the steam-gas mixture is the greatest. The steam arriving in the upper chamber of the dephlegmator at this point contains ten-fifty percent non-condensing gas, so this steam-gas mixture is suitable for the known pumping out using ejectors. Due to the low steam flow rate in the dephlegmator section a relatively low heat transfer coefficient can be attained. This is made significantly worse by the convective heat transfer which receives an increasing role instead of condensation due to the increasing partial pressure of the non-condensing gases. Besides the heat transfer coefficient a further drop in performance is caused by the reducing steam saturation vapour pressure and temperature due to the increasing partial pressure of the non-condensable gases, and, due to this, the increasingly smaller logarithmic temperature difference. The increasing "undercooling" may be a further source of possible freezing up. This risk is discussed by the analysis in the January 1994 issue of the publication POWER (Swanekamp, R: Profit from latest experience with air-cooled condensers).

A further phenomenon occurring in direct cooling by air during condensation is the drop in pressure of the steam (or steam-gas mixture) flowing in the heat exchanger tubes of the condenser and dephlegmator, which also, naturally, depends on the length of the flow route. This loss of pressure due to friction also reduces the logarithmic temperature difference, which acts as the driving force from the point of view of heat transfer, between the cooling medium (air) and the cooled medium (steam). At the same time due to the large specific volume in the case of a direct air condenser of a given size and reducing external air temperature a status may come about when due to the increasing flow losses the reduction of the temperature of the cooling air does not result in the further improvement of cooling performance (so-called choking). The tube length of the heat exchanger sections of condensers and dephlegmators in the case of average or greater power plant cooling is 10 meters for both, in other words the total tube length is doubled by the dephlegmator section.

The lack of uniformity in both the condenser and the dephlegmator, operation reliability problems and controlling difficulties essentially derive from the fact of the so-called direct condensation itself. The condensation occurring inside the tubes, in the whole of the cooling system, in an extended space sets the amount of steam and steam—non-condensing gas mixture and vice versa, the obstacles reducing, or even blocking the flow reduce or stop the condensation. The lack of forced circulation on the condensing medium side makes the control of the process difficult, and interventions can only take place on the outer side of the heat exchanger, on the cooling air side. This explains why direct air cooled condensers have only been constructed with fans till now. Here the forced circulation of the cooling air gives at least the possibility of regulating the airflow. In the case of natural draught direct condensers on both medium sides the flow is "natural", in other words the flow is caused by the process itself, and so the process is nearly uncontrollable—this explains why natural draught direct air cooled systems have never been constructed.

Other direct air cooled systems also exist in which the dephlegmator section is not positioned in a separate heat exchanger bundle, but one of the tubes falling in the flow direction of the air is set up as a dephlegmator, or in a so-called "quasi-single tube" system a part in the one tube separated by a wall serves as a dephlegmator. In these cases the imbalance between the individual tubes increases further, and it becomes even more difficult to control the whole process than those presented earlier using separate condenser-dephlegmator heat exchanger bundles. All this does not change that despite the known and operable direct air cooling technical solutions there is a need for a condensation part and following that a so-called dephlegmator section (which is actually a similar direct steam-air heat exchanger in which the condensation process continues).

It can be determined that the most inefficient, in other words the relatively speaking most expensive part of direct cooling by air is the dephlegmator, which, at the same time, is required for reasons of acceptable operation reliability and controllability.

A mention still needs to be made of endeavours that increase the air cooling performance of air cooling, mainly the peak performance by spraying the cooling surface of the finned air cooling tubes with water, or by establishing a continuous film of water on them. Such is presented in the previously referred to Swanekamp publication (POWER, June 1994).

3. THE INVENTION

The aim of the invention is to establish an air cooled system which as compared to the known direct air cooled solutions improves on the cost effectiveness of these, at the same time as significantly increasing their operation reliability, including operation flexibility, and which makes it possible to control them even in extreme operation conditions, and furthermore, which increases start-up reliability when operation is started.

The air cooled system according to the invention contains a steam-air heat exchanger consisting of tubes finned on the outside suitable for the partial direct condensing of a medium in the vapour state with ambient air, which heat exchanger receives the steam from an upper distribution chamber and ends in a lower chamber, which collects the amount of condensation according to the condensed steam and the steam that has not yet condensed, it has at least one direct contact condenser in which the remaining steam that has not yet condensed coming from the lower collection chamber of the steam-air heat exchanger condenses oh the effect of cooling water cooled in a water-air heat exchanger and sprayed through jets; at the same time the non-condensing gases are removed from the aforementioned direct contact condenser through a suitably structured tray-type or packed after-cooler.

The cooling of the finned heat exchanger tubes takes place with cooling air made to flow by fans or cooling towers providing a natural draught. The heat exchanger bundles belonging to the cooling air made to flow by a common fan is usually called a cell and a series of cells a "bay".

Here also as in the known direct air cooled systems the fin tubes are connected to a lower steam and condensate collection chamber at the end of the tube bundle. The condensation of the remaining, not yet condensed steam in the steam-air segment of the air cooled system takes place in one or more direct contact condensers with cooling water cooled in a water-air heat exchanger; the direct contact condenser or direct contact condensers are connected in series with the water-air heat exchanger or heat exchangers and are connected directly to one another. The condensate passes into the condensate collection pipe due to the effect of gravity.

The steam flowing into the direct contact condenser condenses on the cooling water sprayed in through the condenser jets and cooled in a water-air heat exchanger and passes into the storage part (hot well) of the direct contact condenser together with the heated up cooling water. The pumping out of the non-condensing gases also takes place from the direct contact condenser space.

So the cooling system according to the invention realises the set aim by removing the least efficient dephlegmator part used in the known solutions and detailed earlier and replacing it with a more efficient, more easily controllable and more reliable solution, the water-air cooling segment of the air cooled system according to the invention. So the condensation of the remaining steam is realised in a space significantly smaller than that of the dephlegmator, in a compact direct contact condenser, which as compared to the dephlegmator also provides near ideal conditions for the removal of the non-condensing gases. The heat removal at ambient temperature level takes place in the aforementioned forced circulation water-air heat exchanger, into which only an insignificant amount of non-condensing gas passes as compared to the water current. Due to this in the heat exchanger partly because of the forced circulation and partly because of the lack of non-condensing gases a heat exchange can be realised that is significantly more efficient than that in a dephlegmator, more controllable and less sensitive to operating conditions. At the same time the cooling system according to the invention also retains the more efficient condensation section. This, naturally, does not mean the mechanical replacement of the dephlegmator part used until now, but requires the optimised ratio of the condensation part and the solution replacing the dephlegmator according to the given application. Depending on the application circumstances the condensation section may be reduced to even 30-40 percent of its original dimensions, but at the same time it may also exceed the proportion in the "condenser-dephlegmator" solution.

The solution that in the air cooled system according to the invention the steam that has not condensed in condenser section passes directly into the compact steam space of the direct contact condenser makes it possible to leave out the further steam distribution system used in the known art. Similarly there is no need for the steam, or steam containing an increasing amount of non-condensing gases as a consequence of the condensation, to pass through further long, narrow heat exchanger tubes. All this significantly reduces the steam side pressure drop and the temperature drop involved with this. In the place of the mixture of steam and non-condensing gases, there is water in the water-air heat exchanger as the medium to be cooled. This according to the forced circulation makes completely uniform medium distribution possible on the inside of the heat exchanger tubes. Also the increasing undercooling occurring as a consequence of the partial pressure of air increasing in earlier solutions can be avoided. The heat transfer coefficient on the internal side of the tube will also be significantly more favourable than in the case of the condensation of steam with a high non-condensing gas content. All this all in all results in a more efficient heat exchanger with a smaller surface, which also means that it is cheaper. Also as a result of the reduction of undercooling the efficiency of the power plant cycle is improved to a degree. As the removal of the non-condensing gases takes place in much more favourable circumstances, in a single space, from the direct contact condenser, the amount that has to be pumped out is much less, which makes it possible to use smaller ejectors and less auxiliary energy. The removal of the dephlegmator section also helps ensure a better vacuum by avoiding cooling system "choking" during lower external air temperatures, in other words attaining greater turbine performance. A very significant further result due to leaving out the surface heat exchanger section condensing the steam and non-condensing gas mixture is the avoidance of various problematic operation statuses (gas blockages of varying size or even the formation of water plugs as a consequence of "hold-ups"). This makes it possible to avoid numerous operation problems and have operation that is more reliable and controllable.

In larger air cooled systems the expanded steam arriving from the turbine passes into several parallel-connected steam-air heat exchangers, that is condensers. In such cases not only one direct contact condenser may be used to condense the remaining steam, but several direct contact condensers may be directly connected one to each of the heat exchanger bundles of the steam-air condenser, and then connected on the water side to shorten the steam path.

The steam-air and water-air heat exchanger bundles consisting of finned heat exchanger tubes may not only be placed in cells separated from one another, but also combined in the same cell (so they have a common fan). It is practical here if the individual steam-air heat exchanger bundles are also directly connected to individual, separate direct contact condenser spaces.

Of the two serially connected sections of the air cooled system on the steam side, the replacement of the "rear" dephlegmator section with the more controllable solution presented here assists the controllability of the whole process. So in the solution according to the invention in the place of fans providing the cooling air flow towers inducing a natural draught may be used without endangering operation reliability (which was not possible in the case of purely direct air cooling condensers, as we present in connected with the state of the current art).

In a further version of the invention not only does the non-condensed, remaining steam pass into the direct contact condenser, but the steam can also pass into it directly from a branch with a valve from the expanded, main steam pipe or a branch of it so by-passing the condenser. This makes control of the system and selection of the most efficient operation mode according to the operation requirements easier due to the optimum loading distribution between the steam-air heat exchanger and the water-air heat exchanger. In the case of lower ambient temperatures opening the by-pass pipe and through this sending the loading towards the direct contact condenser and the water-air heat exchanger pushes the "choking" phenomenon towards even lower turbine back pressures, and through this contribute to a further improvement in performance of the power plant.

The peak period increase of performance of the air cooled system according to the invention can be attained if the surface of the finned heat exchanger tubes of the water-air heat exchanger exposed to the flow of cooling air are sprayed with water, or a water film is formed on it by continuous supply. At such a time by opening the aforementioned by-pass pipe valve the heat removal can be partly transferred from the steam-air heat exchanger segment to the wetted water-air heat exchanger segment, which increases the overall performance of the cooling system and via this that of the power plant.

It is possibly practical to couple the installation of a steam shut-off device to the steam side by-pass pipe in the main steam pipe section after the by-pass pipe branch. As it is known that when starting power plants using direct air cooled systems at temperatures under freezing point only following attaining a minimum steam amount (5-10%) may steam be permitted into the direct air cooled condenser in order to avoid the danger of freezing. Until this limit value the steam has to be blown into the air. The solution according to the invention makes the start-up process possible even at a zero steam amount. Opening the steam by-pass pipe valve and closing the main steam pipe valve makes the start-up process possible through the "rear" section (direct contact condenser and water-air heat exchanger) of the serially connected cooling system. As by opening the water cycle by-pass valve it is possible to heat up the cooling water via the direct contact condenser. At this time the water-air heat exchanger is not filled up with water, so the pump that circulates the cooling water circulates the cooling water through the pipe that bypasses the heat exchanger (when the water side by-pass valve fitted in it is open). The filling of the water-air heat exchangers takes place with water heated up in this way, and they will only be put into operation following this. The steam-air heat exchanger (condenser) is only put into operation following the opening of the main steam pipe valve, if the steam flow significantly exceeds the safety value.

In a further advantageous construction form of the solution according to the invention the lower condensate and steam collection chamber of the steam-air heat exchanger (condenser) in the first section of the air cooled system is transformed in such a way that the remaining steam is not fed from the chamber into the body of a separate direct contact condenser. Instead the lower collection chamber serves as a direct contact condenser space itself by feeding the water cooled down in the water-air heat exchanger to the jets positioned in the lower chamber (in its entire length or just in certain sections). Due to this the condensation of the remaining steam takes place in the immediate proximity of exiting from the condenser tubes, in the lower collection chamber. The removal of the non-condensing gases takes place in a suitably formed section of the chamber, preferably containing a tray-type aftercooler. In order to restrict the size of a chamber formed in this way carrying out such a combined task (condensate and remaining steam collection chamber, direct contact condenser space and space suitable for the removal of the non-condensing gases) in one or more places containers need to be installed that serve as the storage part (hot well) of the direct contact condenser for the heated up cooling water and steam condensate. This solution significantly reduces the path of the remaining steam leading to condensation, via this reducing the pressure and, consequently, temperature drops occurring as a consequence of steam friction, as well as the imbalances occurring during this. It is also possible to place the steam-air and water-air heat exchangers in common bundles.

A further favourable solution can be constructed with the integration of the steam-air and water-air heat exchangers. That is not only in one heat exchanger bundle but in every single heat exchanger tube there is a segment creating the steam-air heat exchange and the water-air heat exchange as well. This requires a heat exchanger tube that is stretched in form in the direction of the airflow, and a multifunction lower chamber that carries out several tasks. The lower chamber collects the condensate and remaining steam arriving from the steam-air heat exchanger segment and serves as a direct contact condenser space for the remaining steam. The same space contains a tray-type or packed aftercooler assisting the removal of the non-condensing gases. A part of the space in the lower chamber also serves as the water distribution chamber of the water-air heat exchanger and it is through this that the cooled water is fed to the jet nozzles. Inside the integrated heat exchanger tube starting from the lower collection chamber a part, favourably the part towards the side of entry of the cooling air, is separated from the rest of the tube with a side wall in a plane perpendicular to the direction of flow of the air so that it is suitable for forming the water-air heat exchanger pipe section. It is also practical if this section ends in an intermediate point in the length of the heat exchanger tube, where it is delimited with a closing component positioned in a plane perpendicular to the axis of the tube. The water-air heat exchanger tube section formed in this way may be broken down into further channels with one or more internal separating walls. Using only one internal separating wall, which ends before the upper closing component, a two-pass cross countercurrent water-air heat exchanger can be formed so that from the point of view of the direction of flow of the air the warmed cooling water flows upwards in the inner channel, then turning round at the end of the separating wall it flows downwards in the outer channel where the air enters and then in the meanwhile cools down as a consequence of the cooling effect provided by the finned heat exchanger surface. The steam coming from the turbine gets to the steam-air heat exchanger tube through the upper steam distribution chamber via the whole cross-section of the heat exchanger tube. The steam partly condenses in the section remaining for the steam-air heat exchange, during this not only does the steam flow reduce, but because of the appearance of the water-air heat exchanger section from a certain point the cross-section available for the flow also reduces. The condensate and the remaining steam go to the lower chamber of the heat exchanger bundle that carries out the combined task as presented above. The cooling water cooled down in the outer channel sections is sprayed through the jet nozzles positioned in the lower chamber into the mixing condenser space of the lower chamber. Here it meets the remaining steam arriving from the channels serving as a steam-air heat exchanger over the whole of its length and condenses the greater part of it. In the lower chamber or in a space approaching it is practical to construct a counter-current tray-type or packed after-cooler condenser part, from which the non-condensing gases can be fed to the ejectors under favourable conditions.

In a further sub-version of this solution the externally finned heat exchanger tube elongated in the direction of the airflow is broken up into several channels with separating walls. The steam coming from the turbine here also enters the whole cross-section of the heat exchanger, in other words it enters the heat exchanger tube via all of the channels. Some of these steam-condensation channels run all the way from the upper distribution chamber to the lower collection chamber and end there; the rest of the steam channels start from the upper steam distribution chamber and end at an intermediate point of the length of the heat exchanger pipe. Before the end point of these channels there is a passage opening through the separating wall to the neighbouring steam condensation channel. In another practical solution there are holes or openings repeatedly in the separating walls between the channels used for steam condensation, due to which holes the condensation part become quasi-single channelled (similarly to that in patent specification number WO 98/33028). Two or more, but an even number of the channels of the multi-channel heat exchanger pipe (two of its channels in the case of a total of four channels) are separated from the steam space starting from the lower end up to a certain height (preferably on the cooling air entry side) and serves to form the water-air heat exchanger section.

The solution described here and its variants via its combined and integrated functions, as well as its structural units contribute to the establishment of a more cost-effective and more efficient, due to the avoidance of longer lengths of medium travel, process. As we mentioned steam may enter in the total tube cross-section of all the tubes forming the heat exchangers. Naturally, the steam-air heat exchanger needs to be vacuum sealed. So the uniform water-air heat exchangers integrated into one body with the steam-air sections may also be constructed so that they are vacuum sealed. This makes it possible to re-circulate the warmed up cooling water and for the pressure increase required for the distribution between the heat exchanger tubes to be of such a degree that is required to overcome only the friction of the cycle, so permitting certain sections of the water-air heat exchanger to be under atmospheric pressure. In a heat exchanger formed in this way the condensation takes place in four steps but in a single heat exchanger body, partly in the steam-air heat exchanger section, to a lesser extent along the wall separating the steam and water flow of the individual heat exchanger tubes, with the injection of cooled cooling water in the lower collection chamber also serving as the direct contact condenser space, and finally in the same place in the tray-type after-cooler section leading to where the air is removed.

A further favourable construction form can be realised in a case using an integrated heat exchanger partially similar to the previous case, when within the individual tubes an odd number, even just one, of channels is formed as a water-air heat exchanger. Then from the collection chamber that also serves as a direct contact condenser the warmed up cooling water goes to a storage space, from where the pump transports it to an external distribution cooling water pipe. It is practical if the distribution cooling water pipe runs between the heat exchanger bundles arranged in an A form, and from this there are branches to the channel on the entry side, with respect to the direction of the airflow, of every single tube in an intermediate section of the tubes forming the heat exchanger bundle. The cooling water, in this channel section flowing from its introductions downwards all the way, cools again and is injected into the lower collection chamber that also serves as a direct contact condenser space through nozzles suitable to form jets.

In a further construction form of the integrated heat exchanger the distribution of the heated cooling water again is carried out in the distribution section formed in the lower collection chamber and from here the water to be cooled flows upwards in one channel up to an intermediate section of the whole length of the channel. The cooled cooling water is injected through the holes or nozzles formed in the upper section of the channel into the neighbouring channel, where it carries out the condensation of the remaining steam flowing from the condenser channels through the lower collection chamber into this mixing space. A pipe of significantly smaller cross-section than that of the cross-section of the channel enters every channel section serving as a mixing space "neighbouring" the water cooler channel up to its end. It is through these pipes that the non-condensing gases that become more concentrated in the upper part of the mixing space are sucked out and fed to the collection pipes of the ejection system. This solution gives a favourable result when the conditions justify that the steam-air condensation is to have a dominant role in the heat exchange as compared to the water-air heat exchange.

4. DESCRIPTION OF THE POSSIBLE WAYS OF REALISATION OF THE INVENTION ON THE BASIS OF DRAWINGS

Figure 2:
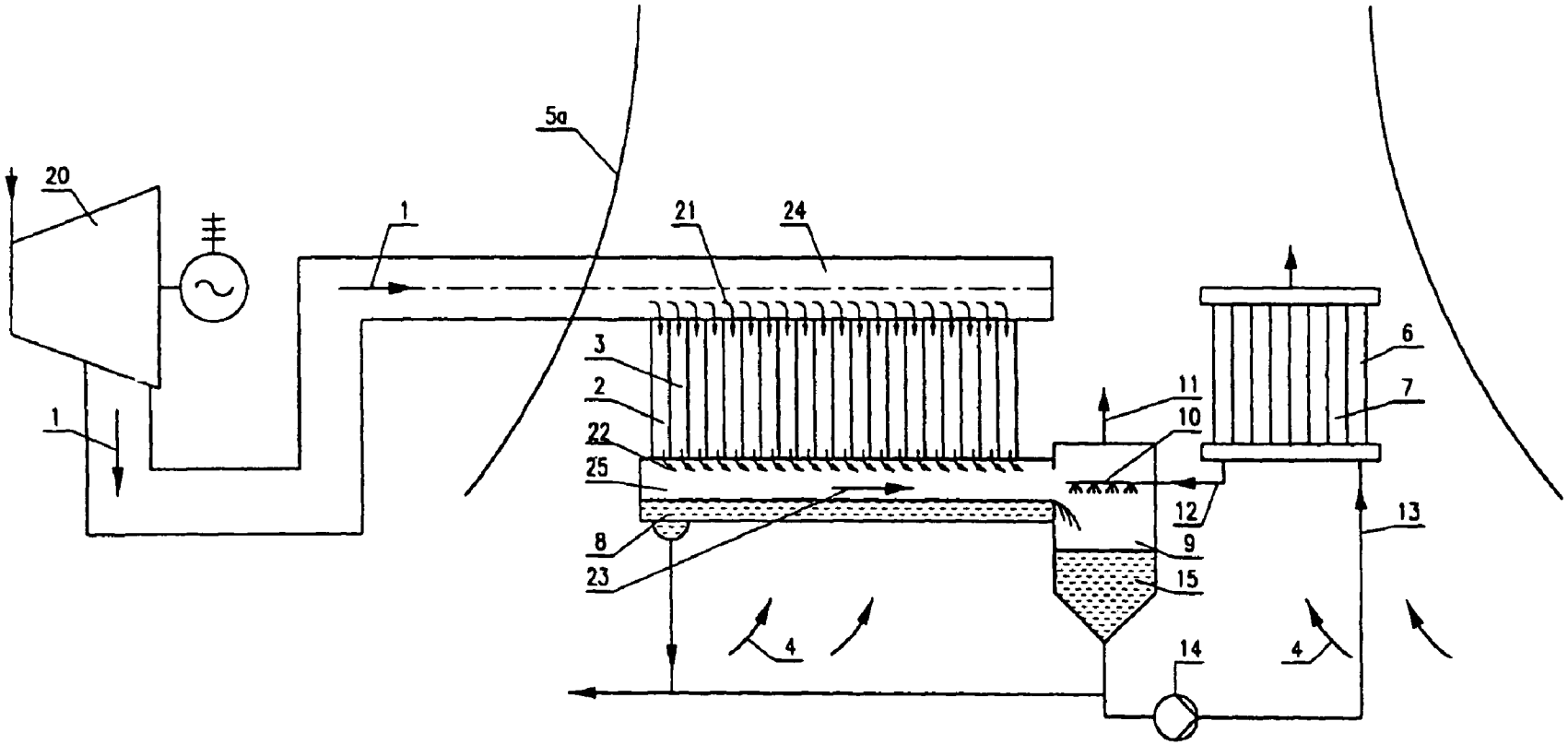
Figure 3:
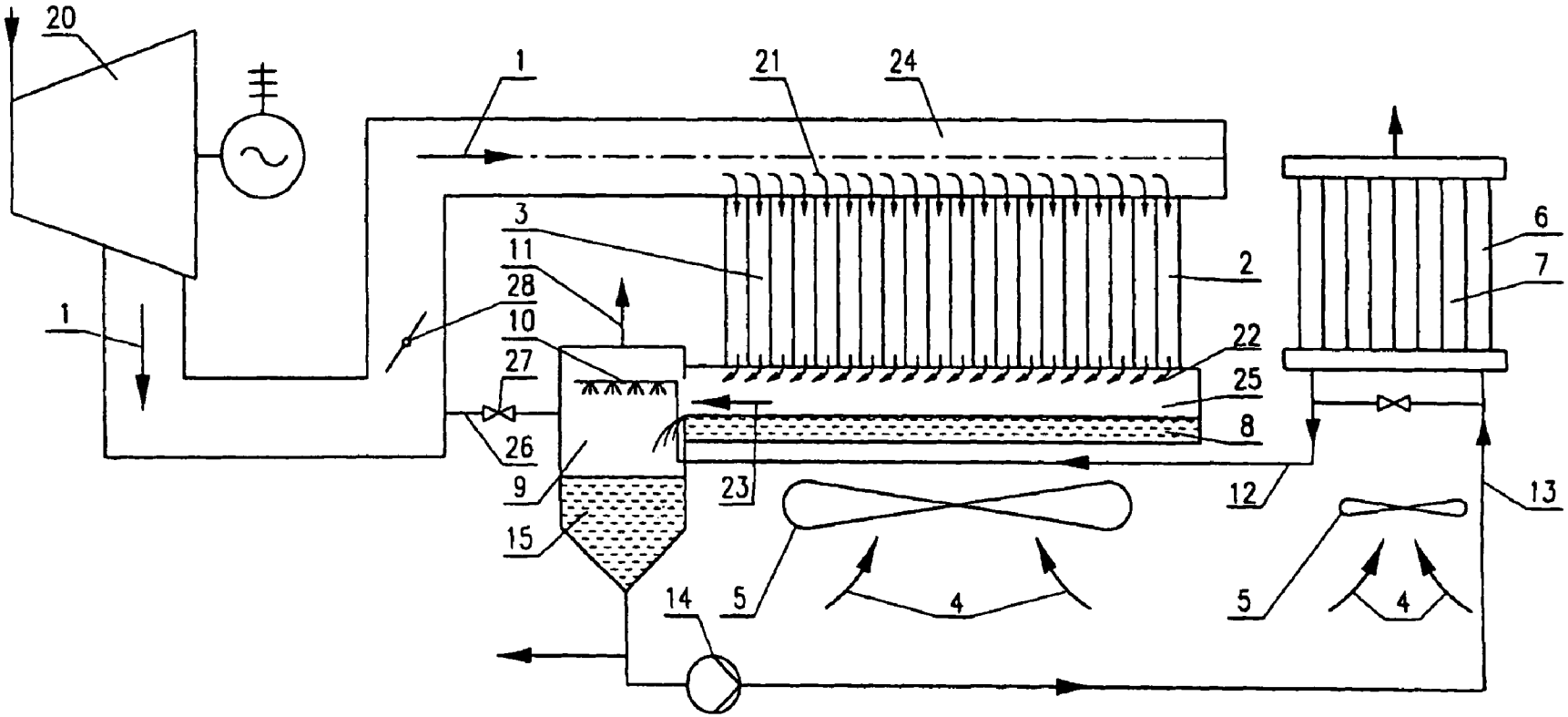
Figure 4:
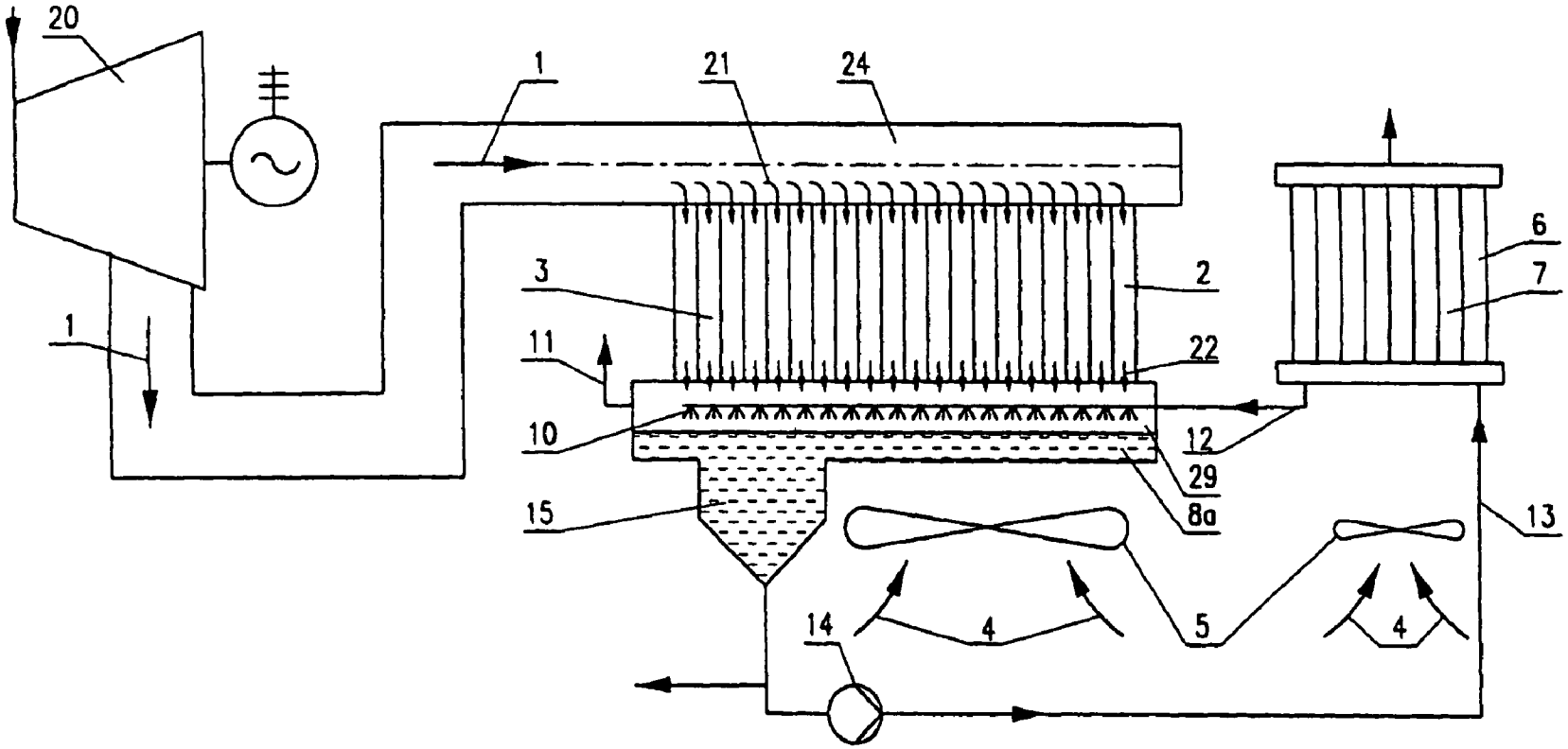

Some favourable constructions of the invention are described in detailed as examples, with the help of figures, where FIG. 1 shows an air cooled system with a steam-air heat exchanger, water-air heat exchanger and a direct contact condenser, FIG. 2 shows a natural-draught air cooled system, FIG. 3 shows an air cooled system where beside the remaining steam of the steam-air heat exchanger the direct contact condenser can also directly condense a part of the steam expanded in the turbine, FIG. 4 shows an air cooled system, where the lower collection chamber of the steam-air heat exchanger also serves as a direct contact condenser, FIG. 5*a* shows an air cooled system with integrated heat exchanger tubes containing a steam-air heat exchanger tube section and a two-pass cross countercurrent water-air heat exchanger pipe section, which ends at an intermediate point of the length of the pipe FIG. 5*b* shows an A-A section of FIG. 5*a,*

FIG. 5*c* shows a B-B section of FIG. 5*b,*

FIG. 6*a* shows an air cooled system with integrated heat exchanger tubes, which contain a steam-air heat exchanger section divided into channels by separating walls, and on the channels ending at an intermediate point of the length of the tube there is a passage opening, and they also contain a two-pass cross countercurrent water-air heat exchanger tube section, FIG. 6*b* shows an A-A section of FIG. 6*a*

FIG. 6*c* shows a B-B section of FIG. 6*b,*

FIG. 7*a* shows an air cooled system with integrated heat exchanger tubes, which contain a steam-air heat exchanger tube section with continuously perforated separating walls, and a two-pass cross countercurrent water-air heat exchanger tube section, which ends at an intermediate point of the length of the tube, FIG. 7*b* shows an A-A section of FIG. 7*a*

FIG. 7*c* shows a B-B section of FIG. 7*b,*

FIG. 8*a* shows an air cooled system with integrated heat exchanger tubes, which contain a steam-air heat exchanger tube section and a single-pass cross flow water-air tube section, the water supply of which is solved from an external water distribution pipe going between the heat exchanger bundles arranged in an A shape, FIG. 8*b* shows a B-B section of FIG. 8*a,*

FIG. 9*a* shows an air cooled system with integrated heat exchanger tubes, which contain a steam-air heat exchanger tube section, a single-pass cross flow water-air tube section, the water supply of which is solved through the lower chamber, and a pipe section situated between the two previously mentioned units, serving as a direct contact condenser space, FIG. 9*b* shows a B-B section of FIG. 9*a.*

The air cooled system in FIG. 1 shows a bundle of the applied steam-air heat exchanger and the water-air heat exchanger each, the direct contact condenser and the way they are connected to each other. The steam to be condensed 1 expanded in the turbine enters the steam-air heat exchanger bundle 3 through the upper steam distribution chamber 24. From the upper steam distribution chamber 24 the steam current to be condensed 21 enters each finned tube of the aforementioned steam-air heat exchanger bundle, which finned tubes serve as air-cooled condensers 2. Flowing through the finned steam-air heat exchanger tube 2 a part of the steam is condensed as a result of the cooling effect of the ambient cooling air 4 moved by the fan 5 (or by some other air moving unit). The condensate 8 and the remaining steam current 22 enter the lower collection chamber 25 from the steam-air heat exchanger tube 2. The accumulated remaining steam 23 does not enter a further steam-air heat exchanger to be condensed there, but it enters a rather compact direct contact condenser 9 connected to the lower collection chamber 25. The cooling water jets entered into the direct contact condenser through the nozzles 10 serve as a surface realising the condensation of the accumulated remaining steam 23. The mixture of the cooling water, which warmed up in the course of the condensation, and the steam condensed in the direct contact condenser 9 are accumulated in the storage part 15 (hot well). The tray-type or packed aftercooler 37, which helps the removal of the non-condensed gases is situated in an appropriate part of the direct contact condenser 9. The non-condensed gases are pumped out from the aftercooler 37 by ejector pumps, through the air removal pipe 11. From the storage part 15 of the direct contact condenser the water, the amount of which is in proportion with the condensed steam, and the condensate 8 from the lower collection chamber 25 of the steam-air heat exchanger 3 enter a condensate pipe. From the storage part 15 of the direct contact condenser 9 the warmed up cooling water 13 is carried to the water-air heat exchanger bundle 7 by a cooling water extraction and circulating pump 14. The warmed up cooling water current 13 is cooled again by the cooling air 4 moved by the fan 5 in the finned tubes 6 of the water-air heat exchanger 7. Practically the recooling takes place in a two-pass cross countercurrent heat exchanger. The cooling water current 12 recooled in the water-air heat exchanger 7 is injected into the direct contact condenser 9 space through the aforementioned nozzles 10. Due to the cyclic process ending like this the dephlegmator used in the known solutions becomes unnecessary.

In the case of tasks demanding greater heat removal the air cooled system shown in FIG. 1 is modified so that the expanded steam 1 arriving from the turbine 20 is distributed into several steam-air heat exchangers 3, that is condensers, parallel connected to each other. In such cases not only one direct contact condenser 9 can be used, but a direct contact condenser 9 can be indirectly connected to each of the heat exchanger bundles of the steam-air condenser 3 separately, so that they can be connected on the water side in order to shorten the steam paths.

In FIG. 1 the steam-air 3 and water-air 7 heat exchanger bundles are shown separated from each other, and in accordance with this they have their own fan 5 each. At the same time it is also possible to place the steam-air 3 and water-air 7 heat exchanger bundles combined with each other in one single cell, and in this case they have a common fan 5.

FIG. 2 shows a solution similar to the one shown in FIG. 1, with the difference that the fans 5 used for moving the cooling air 4 in FIG. 1 are replaced by a cooling tower structure inducing natural draught 5*a*. Instead of the forced circulation of the air it is made possible to use natural draught so that on the medium side there is the forced circulation water-air heat exchanger bundle 7 and the direct contact condenser 9 during the most critical stage; and the condensation of the remaining steam 23 and the removal of the non-condensed gases is solved in or from the direct contact condenser space 9, which can be regarded as compact. As a result of this the influence of external circumstances (air temperature, wind velocity, etc.) is reduced, and the process remains controllable.

The construction example in FIG. 3 shows a construction where the steam to be condensed 1 can get through the steam-air heat exchanger bundle 3 in the form of remaining steam 23, and also through a by-pass steam pipe 26 and through a steam valve 27 situated in it, directly into the direct contact condenser space 9. It significantly improves the controllability of the whole of the cooling system and the selection of the optimal operating mode. If a shut-off valve 28 is also fitted in the main steam distributing pipe, by shutting it off favourable conditions can be ensured even in the case that the temperature is below zero when the power plant block is started, and the cooling system can be started safely and water can be saved. In such cases the start-up takes place at the rear part of the serially connected cooling system, that is through the direct contact condenser 9 and the water-air heat exchanger 7. When the power plant block is started, the water-air heat exchangers are not filled, and the cooling water current flows through only one by-pass pipe, until it is heated to the appropriate temperature. Only after this are the water-air heat exchangers 7 filled and put into operation. The steam-air heat exchanger 3 is put into operation by opening the shut-off valve 28, when the steam current 1 has significantly exceeded the safe value needed for frost-free operation.

FIG. 4 shows a further favourable construction example, where the lower condensate and remaining steam collecting chamber 29 of the steam-air heat exchanger bundle 3 also provides the condensing space of the direct contact condenser. In this way, as opposed to the earlier construction examples shown in FIGS. 1, 2 and 3, no separate direct contact condenser unit 9 is needed. Instead the cooled water current 12 is injected through a line of nozzles 10 situated in the lower collection chamber 29. In this way the condensation of the remaining steam currents 22 discharged from the steam-air heat exchanger tubes 2 and the removal of the non-condensed gases 11 do not simply take place in a separate, otherwise compact direct contact condenser, but without any movement, in the combined lower collection chamber 29 and direct contact condenser space—reducing the losses caused by movements even more. In order to restrict the size of the chamber 29 the container serving as the hot-well of the direct contact condenser 15 must be created to admit the warmed up cooling water 13 and the steam condensate 8*a*.

FIGS. 5*a, b, c*, 6*a, b, c* és 7*a, b, c* show an even higher level of the integration of the functions and the realisation of the process. The most important characteristic feature of these solutions is the combination of the steam-air 3 and the water-air 7 heat exchangers so that they are not only integrated inside one heat exchanger bundle, but inside each finned heat exchanger tube of the heat exchanger bundles. Consequently each integrated finned heat exchanger tube 39 of the integrated air-cooled heat exchanger bundle has a tube section realising steam-air heat exchange 35*a* and a pipe section realising water-air heat exchange 35*b*.

A further important element increasing integration and the combination of the steam-air and water-air cooling unit is a combined-function lower chamber 30, in which the remaining steam 22 arriving from the steam-air section 35*a* and the condensate 8*a* are collected; it also serves as a direct contact condenser space as a result of the fact that the cooled cooling water is injected through the nozzles 10 situated here; the aftercooler 37 helping the removal of the non-condensed gases is also situated here (or in a space closely connected to it), as well as the cooling water distribution space 36 of the water-air heat exchanger tube section 35*b*. Practically the aftercooler 37 is a tray-type or packed device suitable for countercurrent heat and mass transfer. Both sections of the integrated heat exchanger tube 39 have a heat exchanger surface of the same type of geometry, and in accordance with this, similarly to the steam-air heat exchanger pipe section 35*a*, the water-air heat exchanger section 35*b* can also be made in a vacuum tight way. In this way the pump 14*a* used for circulating the warmed up cooling water can be a simple circulation pump instead of the so-called extraction and circulation pump.

Inside the integrated heat exchanger tube 39 the water-air heat exchanger tube section 35*b* is created so that starting from the combined lower chamber 30 a part—practically the part on the side where the cooling air 4 enters—is delimited with a side wall 32 from the other part of the tube, in a plane perpendicular to the flow direction of the air 4. Furthermore, practically this water-air section 35*b* ends at an intermediate point of the length of the integrated heat exchanger tube 39, which is delimited at the top by a closing component situated in a place perpendicular to axis of the integrated heat exchanger tube 39. As a result of this from the upper steam distribution chamber 24 the steam current 21 can enter the steam-air heat exchanger tube section using the complete cross-section of the integrated heat exchanger tube 39.

Inside the finned heat exchanger tubes the separate but integrated construction of the steam-air heat exchanger section 39 and the water-air heat exchanger section 35*b* can be favourable promoted by applying the finned heat exchanger tubes elongated in the flow direction of the cooling air, and by creating channels with separating walls inside the provided cross-section 39, where the channels divide the heat exchanger tube into parts, and in the channels, in accordance with their function stated in the construction examples, the steam medium of the steam-air cooling section and the cooling water medium of the water-air cooling section are conducted.

In the construction examples shown in FIGS. 5*a, b, c* and in the figures described below the heat exchanger pipes according to the invention are divided into channels described above.

The water-air heat exchanger tube section 35*b* constructed as above can be divided into further channels with separating walls. If there is one internal separating wall 34 (which separating wall 34 ends before it reaches the closing component 33), then a two-pass cross countercurrent water-air heat exchanger can be constructed so that with respect to the flow direction of the air 4 the warmed up cooling water 13 flows upwards in the inner channel, then turning back in the space between the end of the separating wall 34 and the closing component 33 it flows downwards in the outer channel on the side where the air enters. During this, as a result of the cooling effect of the surface of the finned integrated heat exchanger tube 39 the cooling water is cools down.

By placing another separating wall 34 the water-air heat exchanger segment 35*b* can be divided into even more paths of an even number.

In accordance with the above the construction example of the cooling system shown in FIGS. 5*a, b, c* and its integrated heat exchanger tube 39 contains a steam-air heat exchanger section 35*a* and the water-air heat exchanger section 35*b* delimited by a closing component 33 and a side wall 32. The water-air heat exchanger section 35*b* is divided into two paths by a separating wall 34. The water being cooled flows upwards in the inner channel with respect to the flow direction of the cooling air, and it flows downwards in the outer channel. (In FIG. 5*c* the water medium is marked with lines, the flow of direction is upwards as compared to the plane of the drawing, marked with sign "−", and downwards as compared to the plane of the drawing, marked with sign "+".) The remaining space part 35*a* of the integrated heat exchanger tube 39 creates the steam-air heat exchanger tube section, in which the steam to be condensed flows downwards. (In FIG. 5*c* the steam medium is in the channel not marked with lines, the flow of direction is downwards as compared to the plane of the drawing, marked with sign "+"). According to the above description from the upper steam distribution chamber 24 the steam 21 enters the steam-air heat exchanger tube section 35*a* through the whole cross-section of the integrated heat exchanger tube 39. Flowing through the whole cross-section the steam 21 gradually condenses, and at the top point of the water-air heat exchanger section 35*b* (which is the closing component 33) cross-section of the steam-air heat exchanger section 35*a* obviously decreases, but here the volume flow rate of the steam is significantly lower. The remaining steam leaving the steam-air cooling section 35*a* is condensed further by the cooled water taken from the water-air section 35*b* and injected into the steam through a nozzle 10, and cooling water-condensed water mixture coming from the steam-air cooling section and created as a result of the injection arrives at the combined collection chamber serving also as a direct contact condenser 30 and enters the storage space 15. Non-condensed gases are removed from the vacuum tight chamber 30 through the aftercooler 37. An amount in proportion with the cooling water is carried from the cooling water-condensate mixture collected in the chamber 30 and in its storage space 15 by a circulation pump into the distribution space 36, from where it is taken back to the water-air heat exchanger section 35*b*.

In the case of a version of the solution described in connection with FIGS. 5*a, b, c* shown in FIGS. 6*a, b, c* the steam-air heat exchanger tube section 35*a* is divided into parallel channels with further separating walls 31 placed in the planes perpendicular to the flow direction of the cooling air. Certain channels of the steam-air heat exchanger tube section 35*a* do not run along the whole length of the channel, but they end at the upper closing component 33 of the water-air heat exchanger tube section 35*b*. At the end of the separating walls 31 of these channels there are openings 41. The steam or condensate flowing in these channels can enter the neighbouring channels through these openings.

In FIGS. 7*a, b, c* a version of the construction example described in connection with FIGS. 5*abc* is shown, where the internal space of the integrated heat exchanger tube 39 containing the a steam-air and a water-air section is divided into parallel channels with separating walls 31*a* in the flow direction of the cooling air, situated in a plane perpendicular to the flow direction, where the walls 31*a* separating certain channels of the steam-air heat exchanger tube segment 35*a* are continuously pierced and perforated in order to make the condensation space a single-channel space.

FIGS. 8*a,b* show a favourable construction example where similarly to FIGS. 5*abc*, 6*abc* and 7*abc* the heat exchanger bundle 40 and each of its heat exchanger tubes 39*a* are elements realising integrated steam condensation and water cooling. At the same time the admission of the warmed up cooling water 13 is passed into the water-air heat exchanger tube section 35*b* placed in the outer channel of the heat exchanger tubes 39*a* from a cooling water distribution pipe 42 led between the heat exchanger bundles 40 arranged in an A shape, in parallel with the plane of the bundles and with the centre-line of the upper steam distribution chamber 24. The cooling water flows downwards and is recooled in the water-air heat exchanger tube section 35*b*, and it is injected through nozzles 10 into the combined lower collection chamber and direct contact condenser space 29*a*. In accordance with this, with respect to the ratio between the steam-air and water-air heat exchanging this solution is practically suitable in the case of a greater proportion. It must be pointed out that the water-air heat exchanger pipe segment 35*b* can be divided into further paths with two or more separating plates of an even number, in a way that in the last path the cooling water flows downwards as described above, and at the end of the channel it is injected into the combined lower collection chamber 29*a* through nozzles 10.

FIGS. 9*a,b* show a further construction example where similarly to FIGS. 5*a, b, c*, 6*a, b, c*, 7*a, b, c* and 8*a,b* an integrated steam-air and water-air heat exchanger bundle 40 is applied, which consists of integrated-function heat exchanger tubes 39*b*. Similarly to FIGS. 8*a,b*, inside the heat exchanger tube 39*b* the water-air heat exchanger section 35*b* uses only one water cooling channel 35*b*. This channel is also the outer channel of the heat exchanger pipe 39*b* situated on the side where the cooling air is entered. Furthermore the water-air heat exchanger section 35*b* does not run along the whole length of the heat exchanger tube in this case either, but at an intermediate height it is delimited with an upper closing component 33 from the steam-air heat exchanger section 35*a*. However, the warmed up cooling water 13 is not admitted through a distribution pipe outside the heat exchanger bundle, but with the help of a water distribution space part 36*a* made in the lower collection chamber 25*a*. Unlike in the case of the solution described in FIG. 8, in this case the cooling water flows upwards, and the recooling process ends as the water reaches the upper part of the water-air heat exchanger section 35*b*. From here the cooling water is injected through nozzles 10 into a heat exchanger pipe section forming a neighbouring combined steam-air condenser and direct contact condenser space 35*c*. At the top the section serving as a combined steam condenser and mixing condenser space 35*c* is also delimited with an upper closing component 33, while on the one side it is separated from the water-air heat exchanger tube section 35*b* with a separating wall 32, and on the other side it is separated from the steam-air heat exchanger pipe section 35*a* with another separating wall 43. The remaining steam enters the lower collection chamber 25*a* from the channels of the steam-air heat exchanger tube section 35*a* (condenser part) running along its whole length, then it changes direction and it flows upwards in the section serving as a combined steam condenser and direct contact condenser space 35*c*, until it condenses as a result of the cooling water injected through nozzles from the water-air heat exchanger section 35*b*. The non-condensed gases become concentrated in the upper part of the heat exchanger tube section forming the condensing space 35*c*. These gases are removed by air removing pipes 44 of a small diameter, running along the section forming the condensing space 35*c*. These air removing pipes join the air removing collecting pipe 45 placed in the combined-function lower chamber 25*a*, and from there they get to the ejector system through air removal 11.

5. SUMMARY

The air cooled system according to the invention, which contains a steam-air cooling section consisting of finned heat exchanger tubes and a serially connected water-air cooling section consisting of finned heat exchanger tubes shows significant advantages as compared to direct cooling by air containing common steam-air heat exchangers only, as a result of adapting to external circumstances,
the possibility to omit dephlegmators,
increasing the flexibility and safety of operation,
increasing controllability,
the possibility to decrease establishment costs.

In the air cooled system according to the invention the integration of the steam-air cooling section and the water-air cooling section in their finned heat exchanger tubes results in a further significant increase of the above advantages.

The invention claimed is:

1. A combined air cooled condenser for processing a vaporized medium from a vapor source, the condenser comprising:

a first cooling volume connected to the vapor source for receiving the vaporized medium from the vapor source and constituting means for performing partial condensation of the vaporized medium resulting in a first condensate, a residual vapor, and non-condensables, the first cooling volume being cooled by a gaseous cooling medium;

a direct contact condenser connected in series to the first cooling volume, the direct contact condenser comprising at least one condenser stage for condensing the residual vapor from the first cooling volume by spraying cooling water thereby converting the residual vapor from the first cooling volume into a second condensate and concentrated non-condensables with vapor; and a second cooling volume connected to the direct contact condenser for receiving the cooling water from the direct contact condenser and for obtaining a cooled down cooling water to be supplied to the direct contact condenser, the second cooling volume being cooled by the gaseous cooling medium;

the direct contact condenser being connected in series with the first and second cooling volumes and further comprising a first outlet for recirculating a first stream of the first and second condensates for reuse, a second outlet for providing a second stream of the cooling water to be supplied to the second cooling volume and a third outlet including an ejector for ejecting the concentrated non-condensables;

wherein the first cooling volume and the direct contact condenser are connected in series with each other and the vapor source and the connection between the first cooling volume and the direct contact condenser is dimensioned such that vaporized medium from the vapor source first passes through the first cooling volume as a first condenser stage and then after partial condensation to the direct contact condenser as a second condenser stage.

2. A combined air cooled condenser according to claim 1, wherein the first cooling volume is defined by a steam-air heat exchanger comprising a series of heat exchanger tubes connected between an upper distribution chamber for distributing the steam among the heat exchanger tubes and a lower collection chamber for collecting the first condensate, the remaining steam and the non-condensables obtained from the heat exchanger tubes.

3. A combined air cooled condenser according to claim 1, wherein the second cooling volume is defined by a water-air heat exchanger comprising a water inlet, a water outlet and a series of heat exchanger tubes connected to the water inlet and the water outlet.

4. A combined air cooled condenser according to claim 1, wherein the direct contact condenser further comprises:

a main condensing section with spraying nozzles for spraying cooling water onto the remaining steam;

a counter-flow tray-type or packed after-cooler part for condensing in a second stage the remaining steam and concentrating the non-condensables to a level required by the ejector; and a storage part for collecting at least a part of the first condensate, the second condensate and the sprayed cooling water.

5. A combined air cooled condenser according to claim 4, wherein the first cooling volume defined by a steam-air heat exchanger and the direct contact condenser are separate units connected to each other directly in series and wherein the lower collection chamber is provided with an outlet for recirculating a stream of the first condensate for reuse, and the direct contact condenser has an outlet for recirculating a stream of the second condensate for reuse.

6. A combined air cooled condenser according to claim 4, wherein the lower collecting chamber and the direct contact condenser are combined with each other, wherein the lower collecting chamber has an enlarged volume for both collecting the first condensate, the remaining steam and the non-condensables obtained from the heat exchanger tubes and for accommodating the spraying nozzles for spraying cooling water onto the mixture of residual steam and non-condensables, the lower collecting chamber being directly connected to the storage part of the direct contact condenser wherein the storage part has an outlet for providing the first stream of the first and second condensates for reuse, and for providing the second stream of the cooling water to be supplied to the second cooling volume and a venting outlet for removing the concentrated non-condensables.

7. A combined air cooled condenser according to claim 5, wherein at least a part of the vaporized medium is lead to the direct contact condenser directly through a first by-pass pipe by opening a valve in the first by-pass pipe and the cooling water collected in the storage part of the direct contact condenser can be returned directly to the direct contact condenser through a second by-pass pipe by opening a second valve in the second by-pass pipe.

8. A combined air cooled condenser according to claim 7, wherein the amount of the vaporized medium is regulated by a shut-off valve arranged in the main steam distributing pipe.

9. A combined air cooled condenser according to claim 1, wherein the first cooling volume defined by a steam-air heat exchanger and the second cooling volume defined by a water-air heat exchanger are integrated in one integrated heat exchanger unit, comprising integrated heat exchanger tubes with an elongated cross-section divided by a first separating wall into a first tube segment for performing steam-air heat exchange and a second tube segment for performing water-air heat exchange.

10. A combined air cooled condenser according to claim 9, wherein the tube segment performing water-air heat exchange extends at the lower end into the combined collecting chamber and direct contact condenser; and at the upper end, which is closed by a closing component, into the integrated heat exchanger tube up to an intermediate point, thereby reducing the cross-section of the combined heat exchanger tube in a lower region, wherein a part of the tube section performing water-air heat exchange is divided into two channels by a second separating wall extending from a lower portion of the first separating wall and having a length for leaving an opening at the closing component.

11. A combined air cooled condenser according to claim 10, wherein the water-air heat exchanger segment is arranged on the air cooled side of the combined heat exchanger tube so that the cooling water entering the water-air heat exchanger segment flows upwards in the inner channel and flows downwards in the outer channel and the first separating wall is connected to the spraying nozzles of the direct contact condenser in a region below the second separation wall.

12. A combined air cooled condenser according to claim 9, wherein the combined lower collecting chamber with a direct contact condenser function has an enlarged volume for both collecting the first condensate obtained from the combined heat exchanger tubes and for accommodating the spraying nozzles for spraying cooling water onto the residual steam, the lower collecting chamber being directly connected to the storage part of the direct contact condenser wherein the storage part has an outlet for providing a first stream of the first and second condensates for reuse, and for providing second stream of cooling water to be supplied to the second cooling volume and a venting outlet for removing the concentrated non-condensables.

13. A combined air cooled condenser according to claim 9, wherein the inner space of the integrated heat exchanger tube is divided into parallel channels by third separating walls extending from the upper end of the integrated heat exchanger tube and having a length for leaving an opening at the closing component through which the steam and the condensate can flow freely into the channels running along the whole length of the heat exchanger tube.

14. A combined air cooled condenser according to claim 13, wherein at least a part of the third separating walls are perforated.

15. A combined air cooled condenser according to claim 9, wherein the tube segment performing water-air heat exchange extends at the lower end into the combined collecting chamber and direct contact condenser; and at the upper end, which is closed by a closing component, into the integrated heat exchanger tube up to an intermediate point, thereby reducing the cross-section of the combined heat exchanger tube in a lower region, wherein the tube segment performing water-air heat exchange is a single channel segment which is connected on the air cooled side in an upper region to an external warmed up cooling water distribution pipe, which in turn is connected to the storage part of the direct contact condenser and the first separating wall being provided with spraying nozzles in a lower region.

16. A combined air cooled condenser according to claim 9, wherein the integrated heat exchanger tube has three segments separated by separating walls into a steam-air heat exchanger tube segment; a water-air heat exchanger tube segment, where the cooling water flowing upwards from the water distribution chamber part of the combined collection chamber is sprayed through nozzles situated at the end of the water-air heat exchanger tube segment, into the third neighboring heat exchanger tube segment serving as a direct contact condenser space; from the upper end of the third tube segment a removal pipe is placed running along the whole length of the third segment, led through and out of the combined lower chamber to remove the concentrated non-condensables.

17. A combined air cooled condenser according to claim 1, wherein the gaseous cooling medium is driven towards the first and second cooling volumes by fans.

18. A combined air cooled condenser according to claim 1, wherein the gaseous cooling medium is driven towards the first and second cooling volumes by a natural draft tower.

19. A combined air cooled condenser according to claim 3, wherein a surface of the water-air heat exchanger is made wet with water sprayed into the cooling air, or a continuous water film is formed on the surface of the water-air heat exchanger.

20. A combined air cooled condenser according to claim 1, wherein the gaseous cooling medium is air.

21. A combined air cooled condenser according to claim 6, wherein at least a part of the vaporized medium is lead to the direct contact condenser directly through a first by-pass pipe by opening a valve in the first by-pass pipe and the cooling water collected in the storage part of the direct contact condenser can be returned directly to the direct contact condenser through a second by-pass pipe by opening a second valve in the second by-pass pipe.

22. A combined air cooled condenser as claimed in claim 1 wherein said vapor source is a steam turbine.

* * * * *